US008736356B2

(12) United States Patent
Yoo

(10) Patent No.: US 8,736,356 B2
(45) Date of Patent: May 27, 2014

(54) MULTI-REGULATOR CIRCUIT AND INTEGRATED CIRCUIT INCLUDING THE SAME

(75) Inventor: Pil Seon Yoo, Seoul (KR)

(73) Assignee: SK Hynix Inc., Gyeonggi-do (KR)

( * ) Notice: Subject to any disclaimer, the term of this patent is extended or adjusted under 35 U.S.C. 154(b) by 0 days.

(21) Appl. No.: 13/619,411

(22) Filed: Sep. 14, 2012

(65) Prior Publication Data

US 2013/0106501 A1 May 2, 2013

(30) Foreign Application Priority Data

Oct. 28, 2011 (KR) ..... 10-2011-0110967

(51) Int. Cl.
*G05F 1/10* (2006.01)

(52) U.S. Cl.
USPC ..... 327/540

(58) Field of Classification Search
USPC ..... 323/312, 313; 327/308, 534, 535, 536, 327/537, 538, 539, 540, 541, 543
See application file for complete search history.

(56) References Cited

U.S. PATENT DOCUMENTS

| | | | | |
|---|---|---|---|---|
| 5,497,119 | A * | 3/1996 | Tedrow et al. | 327/540 |
| 6,377,113 | B1 * | 4/2002 | Kanno | 327/543 |
| 6,949,971 | B2 * | 9/2005 | Jang | 327/541 |
| 6,956,413 | B2 * | 10/2005 | Bailey | 327/131 |
| 8,193,854 | B2 * | 6/2012 | Kuang et al. | 327/539 |
| 8,278,996 | B2 * | 10/2012 | Miki et al. | 327/541 |
| 8,461,913 | B2 * | 6/2013 | Garrard et al. | 327/540 |

FOREIGN PATENT DOCUMENTS

| | | | |
|---|---|---|---|
| KR | 1020000038855 | A | 7/2000 |
| KR | 100574992 | B1 | 4/2006 |
| KR | 1020090090180 | A | 8/2009 |

* cited by examiner

*Primary Examiner* — Jeffrey Zweizig
(74) *Attorney, Agent, or Firm* — William Park & Associates Patent Ltd.

(57) ABSTRACT

A multi-regulator circuit comprises a regulator configured to regulate an input voltage to generate a constant voltage, and a plurality of voltage division circuits configured to output divided voltages which are obtained by dividing the constant voltage on the basis of a plurality of voltage generation codes, respectively.

14 Claims, 6 Drawing Sheets

MULTI-REGULATOR CIRCUIT AND INTEGRATED CIRCUIT INCLUDING THE SAME

CROSS-REFERENCE TO RELATED APPLICATION

The present application claims priority to Korean patent application number 10-2011-0110967 filed on Oct. 28, 2011, in the Korean Intellectual Property Office, which is incorporated by reference herein in its entirety.

BACKGROUND

1. Field of the Invention

Example embodiments relate to a multi-regulator circuit and, more particularly, to a multi-regulator circuit and an integrated circuit including the same.

2. Description of the Related Art

An integrated circuit, such as a semiconductor memory device, is a functionally complex electronic device or system having an ultra-small structure in which many electronic circuit devices are combined on one substrate or combined with the substrate so that devices and the substrate cannot be separated.

An electronic circuit device within the integrated circuit has an ultra-small size, and thus the amount of voltage or a change of current supplied for the operation of the integrated circuit greatly influences malfunctions that may occur in the integrated circuit.

In order to regularly maintain voltage supplied to the integrated circuit, there is a need for a regulator circuit for controlling the output of the voltage supplied to the integrated circuit by a voltage supply circuit.

In general, the regulator circuit regularly maintains an output voltage determined by an input digital code. If a plurality of operating voltages is used within one integrated circuit at the same time, regulator circuits are necessary for each of the operating voltages.

For example, when programming data, a semiconductor memory device requires several operating voltages, such as a program voltage and a pass voltage, at the same time. Accordingly, the semiconductor memory device must be equipped with a regulator circuit for regulating each operating voltage.

If the number of regulator circuits increases within the integrated circuit, however, there is a problem in that a circuit area and consumption power for the integrated circuit are increased.

BRIEF SUMMARY

Example embodiments relate to a multi-regulator circuit and an integrated circuit including the same, which are capable of outputting several voltage levels using a set of regulator circuits.

A multi-regulator circuit according to an aspect of the present disclosure includes a regulator configured to regulate an input voltage to generate a constant voltage; and a plurality of voltage division circuits configured to output divided voltages which are obtained by dividing the constant voltage on the basis of a plurality of voltage generation codes, respectively.

Each of the plurality of voltage division circuits includes a plurality of resistors coupled in series between the output terminal of the regulator and a ground node; at least one high voltage switch enabled by at least one digital bit included in a corresponding voltage generation code and configured to couple at least one of the nodes of the resistors and an output node; and at least one transistor turned on by one or more digital bits, included in the corresponding generation code, but not included in the at least one digital bit inputted to the high voltage switch, and coupled between the ground node and at least one node not coupled to the high voltage switch, from among the nodes of the resistors.

An integrated circuit according to an aspect of the present disclosure includes a controller configured to output control signals for controlling the operation of an internal circuit and a plurality of voltage generation codes; a voltage generator configured to generate a high voltage and a reference voltage in response to an enable signal generated from the controller; a regulator configured to output a regulation voltage having a constant voltage level by using the high voltage and the reference voltage; and a plurality of voltage division circuits configured to output divided voltages obtained by dividing the regulation voltage on the basis of the plurality of voltage generation codes, respectively.

Each of the plurality of voltage division circuits includes first to $13^{th}$ resistors coupled in series between the output terminal of the regulator and a ground node; first to fourth high voltage switches configured to transfer voltage at the node of the first resistor and the second resistor, voltage at the node of the third resistor and the fourth resistor, voltage at the node of the fifth resistor and the sixth resistor, and voltage at the node of the seventh resistor and the eighth resistor, respectively, in response to first to fourth digital bits, respectively, included in a corresponding voltage generation code; and first to fourth transistors coupled between the node of the sixth resistor and the seventh resistor, the node of the ninth resistor and the tenth resistor, the node of the tenth resistor and the $11^{th}$ resistor, and the node of the $11^{th}$ resistor and the $12^{th}$ resistor, respectively, and the ground node and configured to receive fifth to eighth digital bits included in the corresponding voltage generation code through respective gates.

DESCRIPTION OF EMBODIMENTS

Hereinafter, some example embodiments of the present disclosure will be described in detail with reference to the accompanying drawings. The figures are provided to allow those having ordinary skill in the art to understand a scope of the embodiments of this disclosure.

Figure 1:
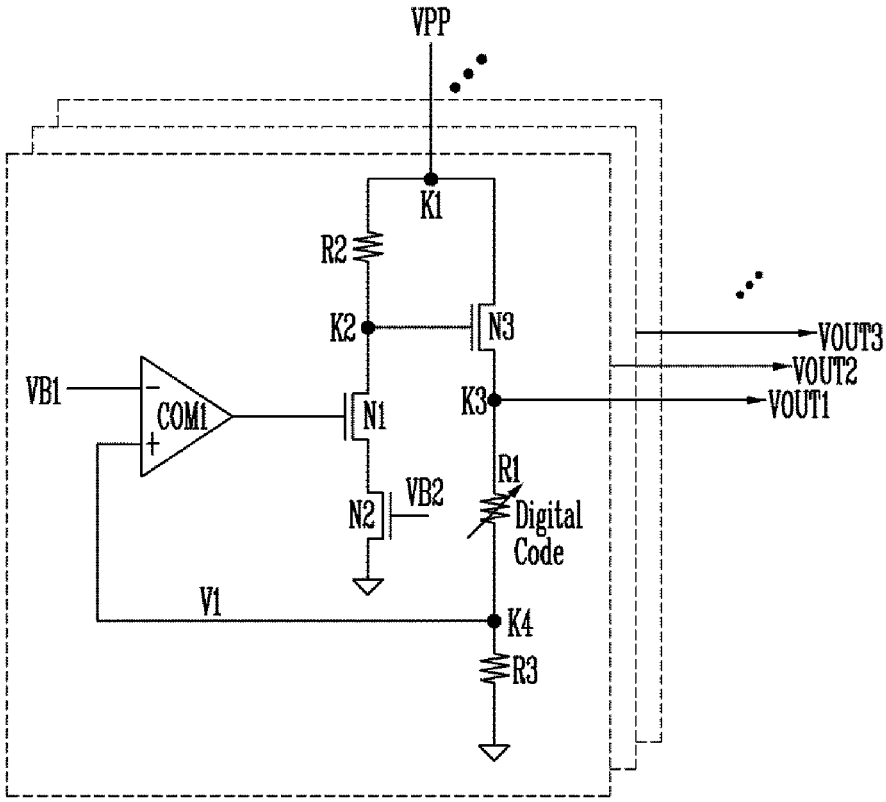
FIG. 1 shows a regulator circuit according to an embodiment of this disclosure.

FIG. 1 shows a regulator circuit according to an embodiment of this disclosure.

Referring to FIG. 1, the regulator circuit includes a first comparator COM1, first to third NMOS transistors N1 to N3, and first to third resistors R1 to R3.

A first reference voltage VB1 is inputted to the inverting terminal − of the first comparator COM1, and a feedback voltage V1 is inputted to the non-inverting terminal + of the first comparator COM1.

The first comparator COM1 outputs a control signal of a low level when the potential of the first reference voltage VB1 is higher than the potential of the feedback voltage V1 and outputs the control signal of a high level when the potential of the first reference voltage VB1 is lower than the potential of the feedback voltage V1.

The control signal of the first comparator COM1 is inputted to the gate of the first NMOS transistor N1.

The second resistor R2 and the first and the second NMOS transistors N1 and N2 are coupled in series between a node K1 and a ground node. The second resistor R2 and the first NMOS transistor N1 are coupled to a node K2.

A high voltage VPP is inputted to the node K1. The node K2 is coupled to the gate of the third NMOS transistor N3. Furthermore, a second reference voltage VB2 is inputted to the gate of the second NMOS transistor N2.

The third NMOS transistor N3 and the first and the third resistors R1 and R3 are coupled in series between the node K1 and the ground node. The third NMOS transistor N3 and the first resistor R1 are coupled to a node K3, and the first resistor R1 and the third resistor R3 are coupled to a node K4.

Voltage at the node K3 is an output voltage VOUT1, and voltage at the node K4 is the feedback voltage V1.

The first resistor R1 is a variable resistor whose resistance value is changed by a set of digital codes. The set of digital codes includes a plurality of bits.

Accordingly, the feedback voltage V1, that is, the voltage of the node K4, is obtained by dividing the output voltage VOUT1, that is, the voltage of the node K3, by the resistance values of the first resistor R1. The resistance values of the first resistor R1 may be determined by the set of digital codes, and the third resistor R3.

The voltage of the node K3 is obtained by dividing the high voltage VPP by the resistance value of the third transistor N3 and the resistance values of the first and the third resistors R1 and R3.

In the regulator circuit, when the resistance value of the first resistor R1 is determined by a set of digital codes, the amount of the feedback voltage V1 is determined.

Accordingly, when the control signal of the first comparator COM1 is changed, the turn-on or turn-off of the first NMOS transistor N1 is controlled.

Furthermore, the degree that the third NMOS transistor N3 is turned on is changed according to the turn-on or turn-off of the first transistor N1. Thus, the voltage of the node K3, that is, the output voltage VOUT1 is determined. The determined output voltage VOUT1 is regularly maintained.

As described above, the regulator circuit regularly controls the one output voltage VOUT1 based on the set of digital codes.

Accordingly, in a known integrated circuit using several operating voltages at the same time as in a semiconductor memory device, the number of regulator circuits is determined by the number of necessary operating voltages.

As the number of operating voltages that are necessary at the same time increases, the number of necessary regulator circuits also increases. Accordingly, an area of the known regulator circuits is increased, and the amount of current consumed in all the regulator circuits is also increased.

In order to solve these problems, a multi-regulator circuit for outputting several output voltages using a single regulator circuit may be used.

Figure 2:
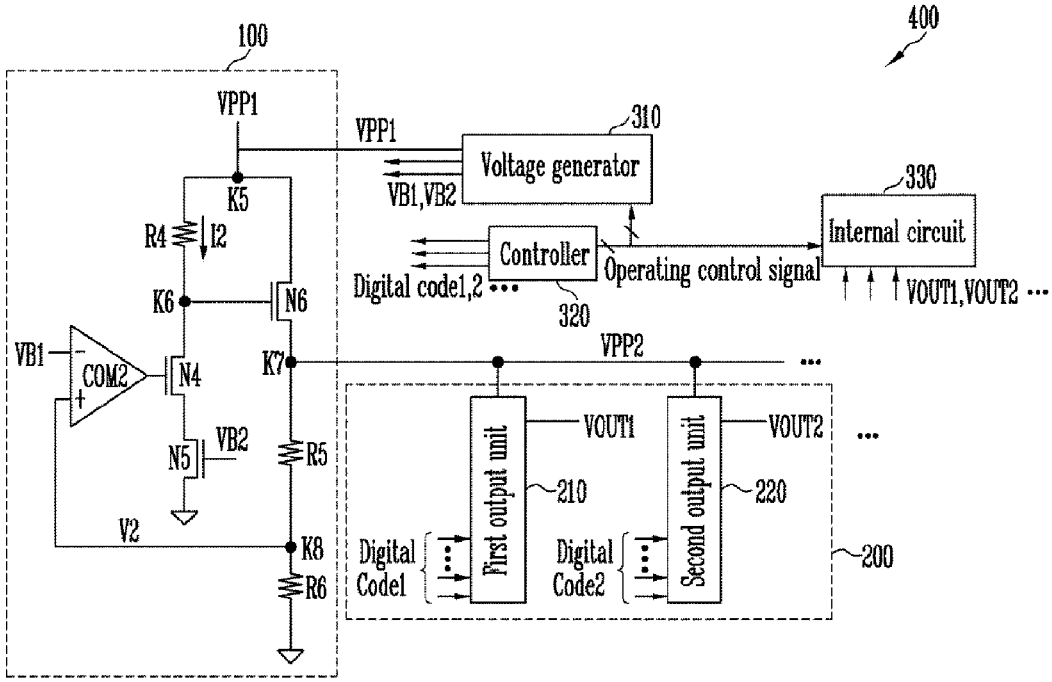
FIG. 2 shows an integrated circuit using a multi-regulator circuit according to an embodiment of this disclosure.

FIG. 2 shows an integrated circuit using a multi-regulator circuit according to an embodiment of this disclosure.

Referring to FIG. 2, the integrated circuit 400 according to an embodiment of this disclosure includes a regulator circuit unit 100, a multi-output unit 200, a voltage generator 310, a controller 320, and an internal circuit 330.

The regulator circuit 100 outputs a regulation voltage VPP2, remaining constant, by using first and second reference voltages VB1 and VB2 and voltage VPP1. In other words, the regulator circuit unit 100 may be configured to regulate voltage VPP1, an input voltage, at a constant voltage level.

The multi-output unit 200 uses the regulation voltage VPP2 in outputting a plurality of output voltages, including, for example, first and second output voltages VOUT1 and VOUT2.

The controller 320 outputs an operating control signal for controlling operations of the voltage generator 310 and the internal circuit 330. Furthermore, the controller 320 outputs several digital codes, including, for example, first and second digital codes Digital Code1 and Digital Code2, in response to the operating voltages for operation of the internal circuit 330. Each of the digital codes includes a plurality of digital bits. The digital codes according to the operating voltages may be stored in the controller 320 in a table form or may be stored in an additional storage means as option information. The controller 320 outputs digital codes according to needed operating voltages.

Furthermore, the multi-output unit 200 outputs a plurality of output voltages based on respective digital codes.

The voltage generator 310 generates the first and the second reference voltages VB1 and VB2 and the voltage VPP1 in response to an operating control signal, such as, an enable signal, generated from the controller 320. Furthermore, the internal circuit 330 performs internal operations on the integrated circuit in response to the plurality of output voltages of the multi-output unit 200 and the operating control signal of the controller 320.

The regulator circuit unit 100 includes a second comparator COM2, fourth to sixth resistors R4 to R6, and fourth to sixth NMOS transistors N4 to N6.

The first reference voltage VB1 is inputted to the inverting terminal − of the second comparator COM2, and a feedback voltage V2 is inputted to the non-inverting terminal + of the second comparator COM2. The second comparator COM2 outputs the control signal of a low level when the potential of the first reference voltage VB1 is higher than the feedback voltage V2 and outputs the control signal of a high level when the potential of the first reference voltage VB1 is lower than the feedback voltage V2.

The control signal of the second comparator COM2 is inputted to the gate of the fourth NMOS transistor N4.

The fourth resistor R4 and the fourth and the fifth NMOS transistors N4 and N5 are coupled in series between a node K5 and a ground node. The fourth resistor R4 and the fourth NMOS transistor N4 are coupled to a node K6. The node K6 is coupled to the gate of the sixth NMOS transistor N6.

The second reference voltage VB2 is inputted to the gate of the fifth NMOS transistor N5.

The sixth NMOS transistor N6 and the fifth and the sixth resistors R5 and R6 are coupled in series between the node K5 and the ground node.

The sixth NMOS transistor N6 and the fifth resistor R5 are coupled to a node K7, and the fifth resistor R5 and the sixth resistor R6 are coupled to a node K8.

The regulation voltage VPP2 is outputted from the node K7, and the feedback voltage V2 is outputted from the node K8. The feedback voltage V2 is divided from the regulation voltage VPP2 by the fifth and the sixth resistors R5 and R6. The regulator circuit unit 100 outputs the regulation voltage VPP2, remaining constant, based on the resistance value of the fifth resistor R5 and the resistance value of the sixth resistor R6 in response to the control signal from the second comparator COM2.

Furthermore, the multi-output unit 200 outputs the plurality of output voltages by using the regulation voltage VPP2.

The multi-output unit 200 includes a plurality of output units including first and second output units 210 and 220. For the sake of simplicity, only two output units 210 and 220 are shown in FIG. 2. In other embodiments, the multi-output unit 200 may include more than two output units.

The output units 210 and 220 output the output voltages based on the respective digital codes Digital Code1 and Digital Code2 generated from the controller 320. Each of the output units 210 and 220 may operate as voltage division units that may include at least one voltage division circuit configured to output a divided voltage, obtained by dividing the regulation voltage VPP2 using resistance varying according to each digital code, as the output voltage.

For example, the first output unit 210 may output a first output voltage VOUT1 having an electric potential determined by the first digital code Digital Code1, and the second output unit 220 may output a second output voltage VOUT2 having an electric potential determined by the second digital code Digital Code2.

The output units of the multi-output unit 210 have a substantially similar construction and may output respective output voltages having different potentials based on respective digital codes.

The construction of only the first output unit 210 is described below as an example.

Figure 3A:
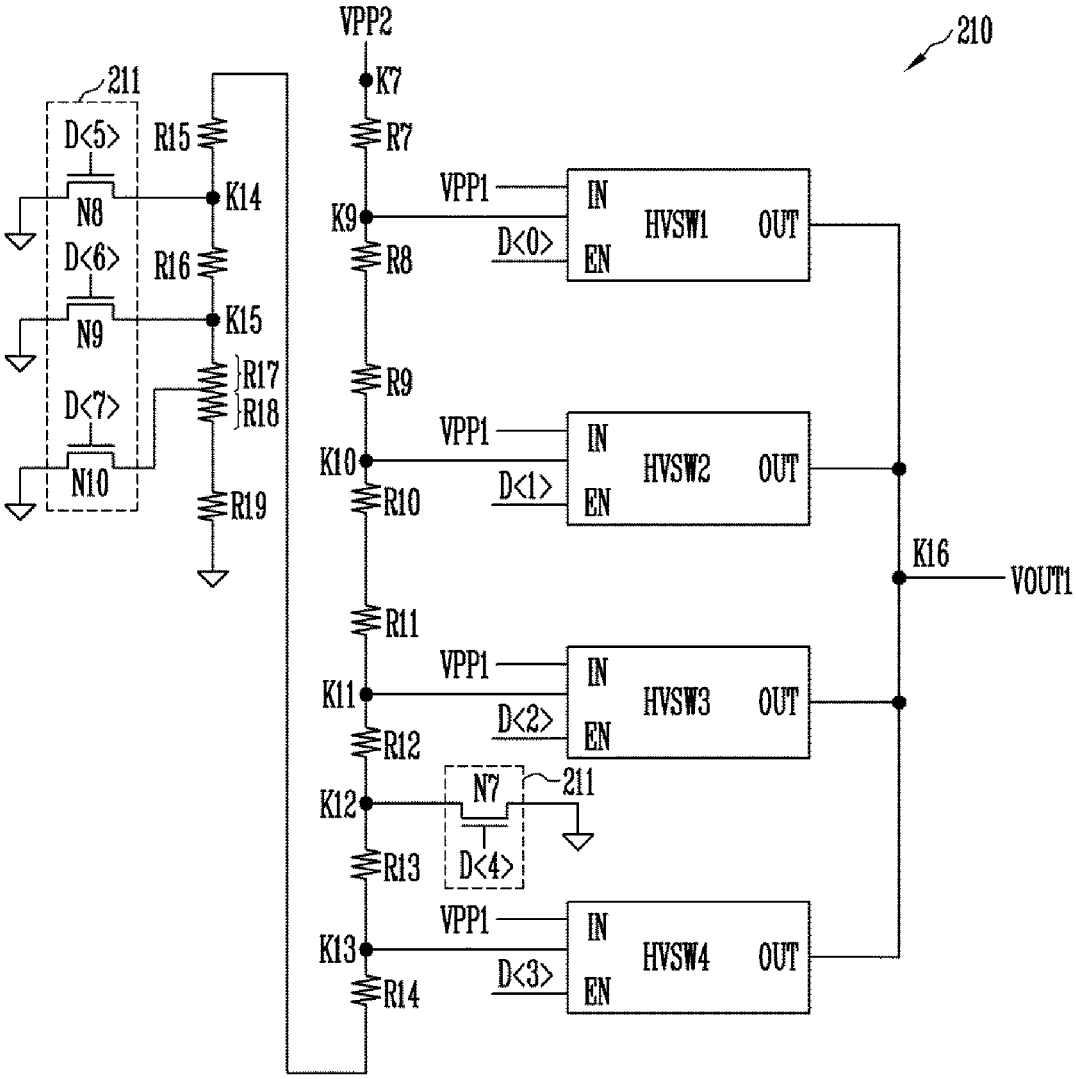
FIG. 3A is a detailed circuit diagram of a first output unit of FIG. 2.

FIG. 3A is a detailed circuit diagram of the first output unit 210 of FIG. 2.

FIG. 3A shows the circuit diagram of the first output unit 210 when the first digital code Digital Code1 includes 8 digital bits. The 8 digital bits of the first digital code Digital Code1 are hereinafter denoted by first to eighth digital bits D<0> to D<7>, respectively. The first to eighth digital bits D<0> to D<7> may comprise a voltage generation code, where each voltage generation code may be different from one another.

Referring to FIG. 3A, the first output unit 210 includes first to fourth high voltage switches HVSW1 to HVSW4, seventh to $19^{th}$ resistors R7 to R19, seventh to tenth NMOS transistors N7 to N10.

The seventh to $19^{th}$ resistors R7 to R19 are coupled in series between a node K7, at which the regulation voltage VPP2 is supplied, and the ground node.

The seventh resistor R7 and the eighth resistor R8 are coupled to a node K9, and the ninth resistor R9 and the tenth resistor R10 are coupled to a node K10. Furthermore, the $11^{th}$ resistor R11 and the $12^{th}$ resistor R12 are coupled to a node K11.

The $12^{th}$ resistor R12 and the $13^{th}$ resistor R13 are coupled to a node K12, and the $13^{th}$ resistor R13 and the $14^{th}$ resistor R14 are coupled to a node K13. Furthermore, the $15^{th}$ resistor R15 and the $16^{th}$ resistor R16 are coupled to a node K14.

The $16^{th}$ resistor R16 and the $17^{th}$ resistor R17 are coupled to a node K15.

The seventh to $16^{th}$ resistors R7 to R16 and the $19^{th}$ resistor R19 have the same resistance value as each other. Furthermore, the $17^{th}$ and the $18^{th}$ resistors R17 and R18 have the same resistance value as each other. The resistance value of the seventh resistor R7, however, may be twice the resistance value of the $17^{th}$ resistor R17. That is, assuming that each of the resistance values of the seventh to $16^{th}$ resistors R7 to R16 and the $19^{th}$ resistor R19 is 'K' each of the $17^{th}$ and $18^{th}$ resistors R17 and R18 has a resistance value of 'K/2'.

The first to fourth high voltage switches HVSW1 to HVSW4 of the first output unit 210 are enabled in response to the first to fourth digital bits D<0> to D<3>, respectively. Voltage inputted to the input terminal IN of each of the first to fourth high voltage switches HVSW1 to HVSW4 is outputted to the output terminal OUT of each of the first to fourth high voltage switches HVSW1 to HVSW4.

Figure 3B:
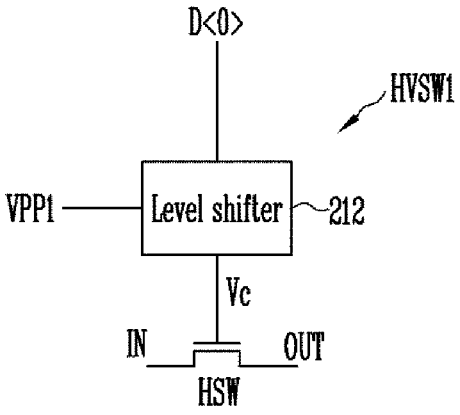
FIG. 3B is a detailed circuit diagram of a first high voltage switch of FIG. 3A.

Each of the first to fourth high voltage switches HVSW1 to HVSW4 may be formed of several switch circuits for transferring a high voltage. For example, each of the first to fourth high voltage switches HVSW1 to HVSW4 may be formed as shown in FIG. 3B. FIG. 3B will be described in detail later.

The fifth to eighth digital bits D<4> to D<7> are inputted to the gates of the seventh to tenth NMOS transistors N7 to N10, respectively. The fifth to eighth digital bits D<4> to D<7> may be included in the voltage generation code, but the fifth to eighth digital bits D<4> to D<7> are typically not inputted to the first to fourth high voltage switches HVSW1 to HVSW4.

The seventh to tenth NMOS transistors N7 to N10 form respective circuits 211 for changing the ground node of the first output unit 210. One of the seventh to tenth NMOS transistors N7 to N10 may be turned on and coupled to the ground node. The level of voltage to be outputted may be controlled by selecting one of the seventh to tenth NMOS transistors N7 to N10 together with the first to fourth high voltage switches HVSW1 to HVSW4, where each of the seventh to tenth NMOS transistors N7 to N10 may be coupled with the ground node and at least one node not coupled with one of the high voltage switches HVSW1 to HVSW4.

The seventh NMOS transistor N7 is coupled between the node K12 and the ground node, and the eighth NMOS transistor N8 is coupled between the node K14 and the ground node. The ninth NMOS transistor N9 is coupled between the node K15 and the ground node.

Furthermore, the tenth NMOS transistor N10 is coupled between the ground node and the node to which the $17^{th}$ resistors R17 and the $18^{th}$ resistor R18 are coupled.

The first to fourth high voltage switches HVSW1 to HVSW4 have a substantially similar construction, and thus only the first high voltage switch HVSW1 is described in detail as an example.

FIG. 3B is a detailed circuit diagram of the first high voltage switch HVSW1 of FIG. 3A.

Referring to FIG. 3B, the first high voltage switch HVSW1 includes a level shifter 212 and a high voltage transistor HSW.

The high voltage transistor HSW is turned on in response to control voltage Vc inputted to the gate of the high voltage transistor HSW. In order for the high voltage transistor HSW to transfer voltage, inputted to an input terminal IN thereof to an output terminal OUT thereof without a voltage loss, the control voltage Vc inputted o the gate of the high voltage transistor HSW must have a high voltage, for example, approximately the voltage VPP1.

Although the first digital bit D<0> of a high level is inputted to the gate of the high voltage transistor HSW, the output terminal OUT of the high voltage transistor HSW has a low voltage almost equal to a power source voltage. Accordingly, if the first digital bit D<0> is inputted to the gate of the high voltage transistor HSW without change, voltage inputted to the input terminal IN of the high voltage transistor HSW cannot be transferred to the output terminal OUT of the high voltage transistor HSW without a loss.

In order to solve this problem, the level shifter 212 changes the voltage level of the first digital bit D<0> into the voltage VPP1 and outputs the voltage VPP1 as the control voltage Vc. Accordingly, the high voltage transistor HSW can output voltage, inputted to the input terminal IN thereof, to the output terminal OUT thereof without a voltage loss.

The operation of the first output unit 210 is described below, assuming that the first to eighth digital bits D<0> to D<7> are inputted as "01000000".

The second digital bit D<1> of the first to eighth digital bits D<0> to D<7> has a value '1'.

Accordingly, the second high voltage switch HVSW2 of the first output unit 210 is turned on, and all the seventh to ninth NMOS transistors N7 to N9 are turned off. This is shown in FIG. 3C.

Figure 3C:
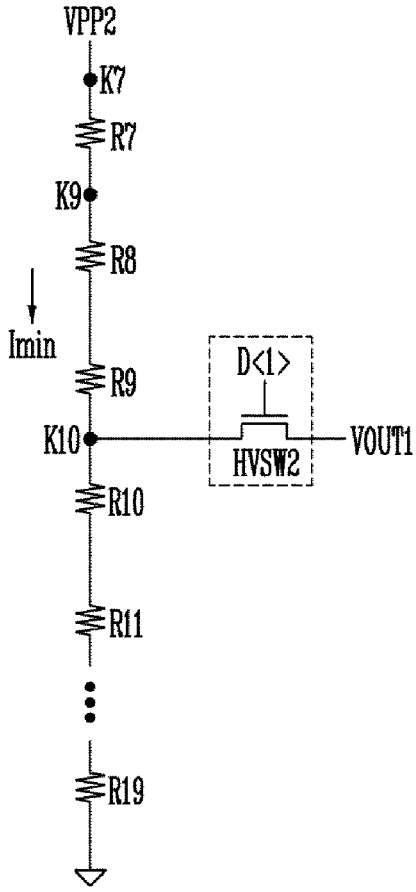
FIGS. 3C and 3D show circuits of the first output unit when a first digital code is received.
Figure 3D:
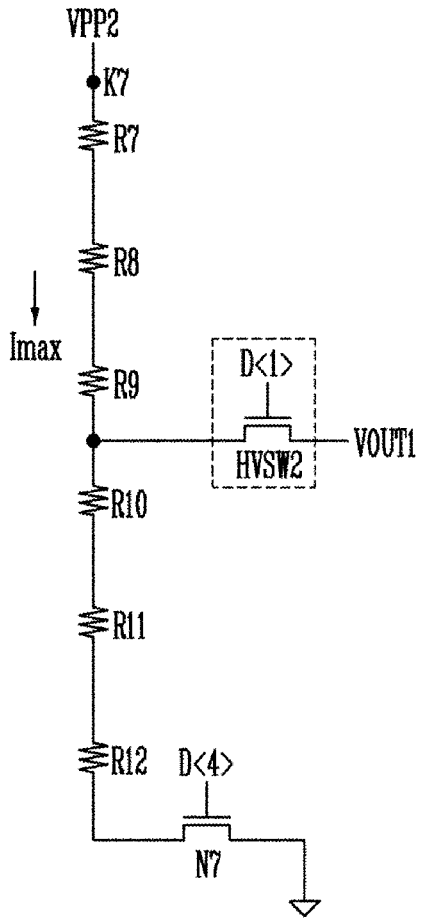

FIGS. 3C and 3D show the circuits of the first output unit when a first digital code is received.

Referring to FIG. 3C, when the second high voltage switch HVSW2 of the first output unit 210 is turned on, the seventh to $19^{th}$ resistors R7 to R19 are coupled in series between the node K7 and the ground node, and voltage at the node K10 becomes the first output voltage VOUT1. In this case, a circuit, for example a voltage division circuit, such as that shown in FIG. 3C, is formed by the first output unit 210.

Accordingly, the amount of voltage outputted is determined by Equation 1 below.

$$VOUT1 = VPP2 \times \frac{R10 + R11 + \ldots + R19}{R7 + R8 + R9 + \ldots + R19} = VPP2 \times \frac{9K}{12K} \quad \text{[Equation 1]}$$

Assuming that a resistance value 'K' is 1 and the regulation voltage VPP2 is 12 V according to Equation 1, the outputted voltage is approximately 9 V.

When the first to eighth digital bits D<0> to D<7> of "01001000" are inputted, the second high voltage switch HVSW2 is turned on and the seventh NMOS transistor N7 is turned on. In this case, a circuit, for example, a voltage division circuit, such as that shown in FIG. 3D, is formed by the first output unit 210.

Accordingly, the first output voltage VOUT1 is determined according to Equation 2 below.

$$VOUT1 = VPP2 \times \frac{R10 + R11 + R12}{R7 + R8 + R9 + R10 + R11 + R12} = VPP2 \times \frac{3K}{6K} \quad \text{[Equation 2]}$$

Assuming that the resistance value K is "1" and the regulation voltage VPP2 is 12 V according to Equation 2, an output voltage becomes 6 V.

The first output voltage VOUT1 outputted through the second high voltage switch HVSW2 may be controlled so that it has 6 V to 9 V depending on how the fourth to eighth digital bits D<4> to D<7> are inputted.

Likewise, the first output voltage VOUT1 outputted through the first high voltage switch HVSW1 is the highest when the fifth to eighth digital bits D<4> to D<7> are "0000" and is the lowest when the fifth to eighth digital bits D<4> to D<7> are "1000". The first output voltage VOUT1 outputted through the first high voltage switch HVSW1 may be controlled so that it has 10 V to 11 V.

The first output voltage VOUT1 outputted through the third high voltage switch HVSW3 is the highest when the fifth to eighth digital bits D<4> to D<7> are "0000" and is the lowest when the fifth to eighth digital bits D<4> to D<7> are "1000". The first output voltage VOUT1 outputted through the third high voltage switch HVSW3 may be controlled so that it has 2 V to 7 V.

The first output voltage VOUT1 outputted through the fourth high voltage switch HVSW4 is the highest when the fifth to eighth digital bits D<4> to D<7> are "0000" and is the lowest when the fifth to eighth digital bits D<4> to D<7> are "0100". The first output voltage VOUT1 outputted through the fourth high voltage switch HVSW4 may be controlled so that it has 2.8 V to 5 V.

As described above, the first output unit 210 may generate various voltages ranging from 2.8 V to 11 V. If the first output unit 210 is used in the integrated circuit 400, the first output unit 210 is commonly used to generate only voltages that rise by a constant voltage level. Accordingly, the controller 320 of the integrated circuit 400 of FIG. 2 outputs the eight sets shown in Table 1 below.

TABLE 1

| D<0> | D<1> | D<2> | D<3> | D<4> | D<5> | D<6> | D<7> | VOUT1 |
|---|---|---|---|---|---|---|---|---|
| 1 | 0 | 0 | 0 | 0 | 0 | 0 | 0 | 11 V |
| 1 | 0 | 0 | 0 | 1 | 0 | 0 | 0 | 10 V |
| 0 | 1 | 0 | 0 | 0 | 0 | 0 | 0 | 9 V |
| 0 | 1 | 0 | 0 | 0 | 1 | 0 | 0 | 8 V |
| 0 | 0 | 1 | 0 | 0 | 0 | 0 | 0 | 7 V |
| 0 | 0 | 1 | 0 | 0 | 0 | 1 | 0 | 6 V |
| 0 | 0 | 0 | 1 | 0 | 0 | 0 | 0 | 5 V |
| 0 | 0 | 0 | 1 | 0 | 0 | 0 | 1 | 4 V |

As shown in Table 1, when the first high voltage switch HVSW1 is turned on, the fifth to eighth digital bits D<4> to D<7> are inputted as only "0000" or "1000". Accordingly, the first output voltage VOUT1 may be set to 11 V or 10 V.

When the second high voltage switch HVSW2 is turned on, the fifth to eighth digital bits D<4> to D<7> are inputted as "0000" or "0100". Accordingly, the first output voltage VOUT1 may be set to 9 V or 8 V.

When the third high voltage switch HVSW3 is turned on, the fifth to eighth digital bits D<4> to D<7> are inputted as "0000" or "0010". Accordingly, the first output voltage VOUT1 may be set to 7 V or 6 V.

Furthermore, when the fourth high voltage switch HVSW4 is turned on, the fifth to eighth digital bits D<4> to D<7> are inputted as "0000" or "0010". Accordingly, the first output voltage VOUT1 may be set to 5 V or 4 V.

That is, the first output voltage VOUT1 may be set from 4 V to 11 V for 1 V voltage.

Regarding current I consumed while the first output unit 210 outputs the first output voltage VOUT1, the smallest current Imin flows when the first output voltage VOUT1 has the highest level, and the greatest current Imax flows when the first output voltage VOUT1 has the lowest level.

The current I consumed while the first output unit 210 outputs the first output voltage VOUT1, varies depending on the values of the inputted fourth to eighth digital bits D<4> to D<7>. The ground GND of the first output unit 210 is changed by the fourth to eighth digital bits D<4> to D<7>. That is, voltage and current may be controlled according to a moving ground method.

Current consumption when the regulator circuit is included having voltage outputted as shown in FIG. 1 is calculated according to Equation 3 below.

$$\text{Current consumption}=(\text{comparator current}+\text{output driver current}\times 2)\times N \quad \text{[Equation 3]}$$

The comparator current is current consumed by the first comparator COM1 of FIG. 1, and the output driver current is current consumed by the second resistor R2. Furthermore, 'N' denotes the number of necessary regulator circuits.

If a regulator circuit, such as that shown in FIG. 2, is used, current, such as that according to Equation 4, is consumed.

$$\text{Current consumption}=\text{comparator current}+\text{output driver current}+\text{output unit current}\times N \quad \text{[Equation 4]}$$

In Equation 4, the output unit current is current consumed by each of the output units of the multi-output unit 200. It can be seen that, if N output voltages are necessary, current consumed by a multi-regulator circuit, such as that shown in FIG. 2, is much smaller than current consumed by the regulator circuits of FIG. 1 according to Equation 3 and Equation 4.

Figure 4:
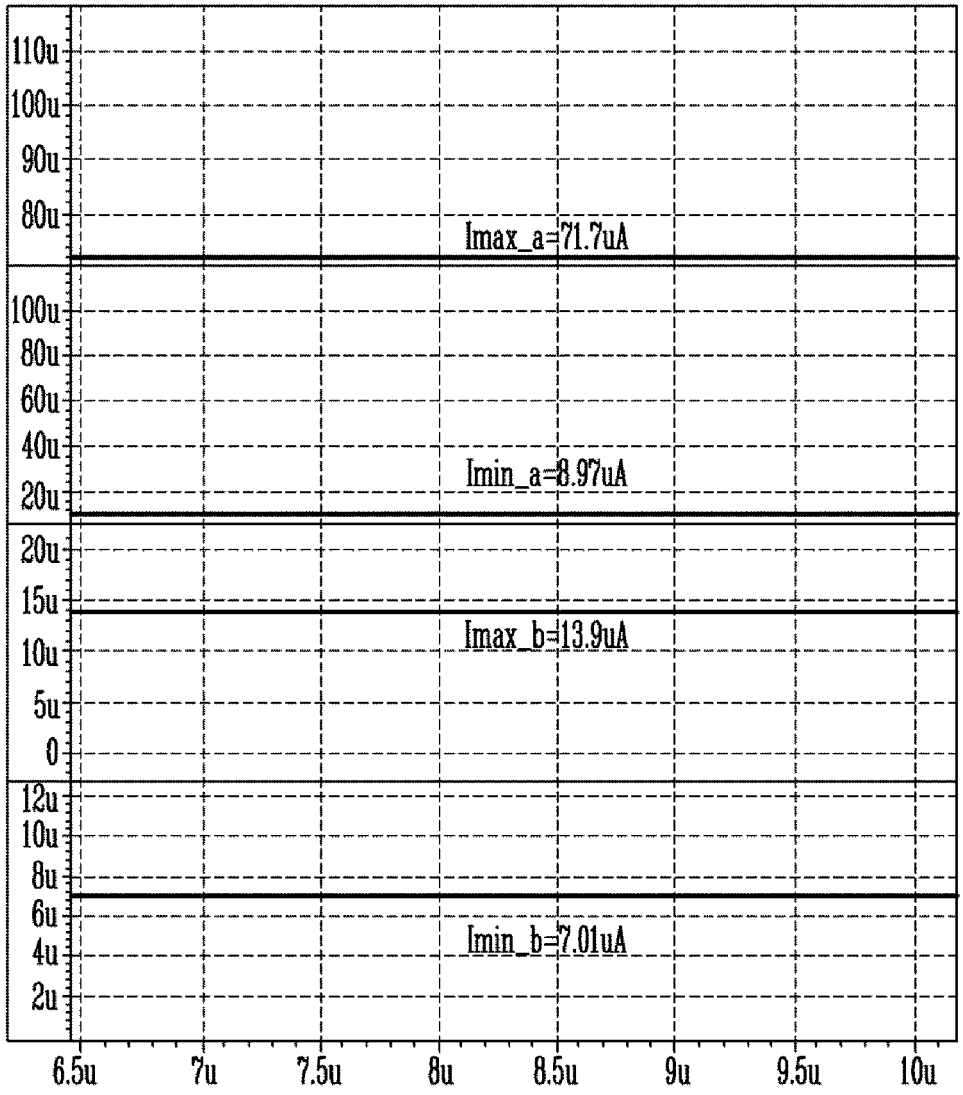
FIG. 4 shows current amounts resulting from output voltages that are simulated in the regulator circuits of FIGS. 1 and 2.

FIG. 4 shows current amounts resulting from output voltages that are simulated in the regulator circuits of FIGS. 1 and 2.

FIG. 4 shows current simulation results when voltage shifts between 4 V and 10 V when the inputted voltage VPP1 is 13 V.

FIG. 4 shows that the amount of current Imax_b and Imin_b consumed by the multi-regulator circuit of FIG. 2 when the multi-output unit 200 is included with one regulator circuit is much smaller than the amount of current Imax_a and Imin_a when several regulator circuits are used as in FIG. 1.

In accordance with this disclosure, the multi-regulator circuit and the integrated circuit including the same can output several voltage levels by using a set of circuits having a regulation function. Accordingly, a circuit area can be reduced, and consumption current can be reduced.

What is claimed is:

1. A multi-regulator circuit, comprising:

a regulator configured to regulate an input voltage to generate a constant voltage; and a plurality of voltage division circuits configured to output divided voltages which are obtained by dividing the constant voltage on the basis of a plurality of voltage generation codes, respectively, wherein each of the plurality of voltage division circuits comprises:

a plurality of resistors coupled in series between an output terminal of the regulator and a ground node;

a plurality of nodes connecting each of the plurality of resistors to the next resistor;

at least one high voltage switch enabled by at least one digital bit included in a corresponding voltage generation code and configured to couple at least one of the plurality of nodes and an output node; and at least one transistor turned on by one or more digital bits, included in the corresponding voltage generation code, but not included in the at least one digital bit inputted to the at least one high voltage switch, and coupled between the ground node and at least one of the plurality of nodes not coupled to the high voltage switch.

2. The multi-regulator circuit of claim 1, wherein the regulator comprises a comparator configured to compare a feedback voltage divided from the constant voltage of the regulator with a reference voltage and output a control signal according to a result of the comparison, and the constant voltage of the regulator is provided to the plurality of voltage division circuits in response to the control signal.

3. The multi-regulator circuit of claim 1, wherein:

each of the plurality of voltage generation codes inputted to each of the plurality of voltage division circuits includes a plurality of digital bits, and the plurality of voltage generation codes are different from one another.

4. The multi-regulator circuit of claim 1, wherein each of the plurality of voltage division circuits is configured to divide the constant voltage according to an internal resistance value which is determined by a corresponding voltage generation code.

5. The multi-regulator circuit of claim 1, wherein the plurality of voltage division circuits is coupled to an output terminal of the regulator and commonly receives the constant voltage via the output terminal.

6. An integrated circuit, comprising:

a controller configured to output control signals for controlling an operation of an internal circuit and a plurality of voltage generation codes;

a voltage generator configured to generate a high voltage and a reference voltage in response to an enable signal generated from the controller;

a regulator configured to output a regulation voltage having a constant voltage level by using the high voltage and the reference voltage; and a plurality of voltage division circuits configured to output divided voltages obtained by dividing the regulation voltage on the basis of the plurality of voltage generation codes, respectively.

7. The integrated circuit of claim 6, wherein the regulator comprises a comparator configured to compare a feedback voltage divided from the regulation voltage of the regulator with the reference voltage and output a control signal according to a result of the comparison, and the regulation voltage of the regulator is provided to the plurality of voltage division circuits in response to the control signal.

8. The integrated circuit of claim 6, wherein each of the plurality of voltage division circuits comprises:

a plurality of resistors coupled in series between an output terminal of the regulator and a ground node;

a plurality of nodes connecting each of the plurality of resistors to the next resistor;

at least one high voltage switch enabled by at least one digital bit included in a corresponding voltage generation code and configured to couple at least one of the plurality of nodes of the resistors and an output node; and at least one transistor turned on by one or more digital bits, included in the corresponding voltage generation code, but not included in the at least one digital bit inputted to the at least one high voltage switch, and coupled between the ground node and at least one of the plurality of nodes not coupled to the high voltage switch.

9. The integrated circuit of claim 6, wherein each of the plurality of voltage division circuits comprises:

first to $13^{th}$ resistors coupled in series between an output terminal of the regulator and a ground node;

first to fourth high voltage switches configured to transfer voltage at a node of the first resistor and the second resistor, voltage at a node of the third resistor and the fourth resistor, voltage at a node of the fifth resistor and the sixth resistor, and voltage at a node of the seventh resistor and the eighth resistor, respectively, to an output node in response to first to fourth digital bits, respectively, included in a corresponding voltage generation code; and first to fourth transistors coupled between a node of the sixth resistor and the seventh resistor, a node of the ninth resistor and the tenth resistor, a node of the tenth resistor and the $11^{th}$ resistor, and a node of the $11^{th}$ resistor and the $12^{th}$ resistor, respectively, and the ground node and configured to receive fifth to eighth digital bits included in the corresponding voltage generation code through respective gates.

10. The integrated circuit of claim 9, wherein:

each of the first to tenth resistors and the $13^{th}$ resistor has a first resistance value, each of the $11^{th}$ resistor and the $12^{th}$ resistor has a second resistance value, and the second resistance value is half the first resistance value.

11. The integrated circuit of claim 6, wherein each of the plurality of voltage generation codes inputted to each of the plurality of voltage division circuits includes a plurality of digital bits, and the plurality of voltage generation codes are different from one another.

12. The integrated circuit of claim 6, wherein the plurality of voltage generation codes is determined by levels of voltages to be supplied to the internal circuit.

13. The integrated circuit of claim 6, wherein each of the plurality of voltage division circuits is configured to divide the regulation voltage according to an internal resistance value which is determined by a corresponding voltage generation code.

14. The integrated circuit of claim 6, wherein the plurality of voltage division circuits is coupled to an output terminal of the regulator and commonly receives the regulation voltage via the output terminal.

* * * * *